US008590463B1

(12) United States Patent
Higgins et al.

(10) Patent No.: US 8,590,463 B1
(45) Date of Patent: Nov. 26, 2013

(54) METHOD AND APPARATUS FOR DRYING SOLID FUELS

(76) Inventors: Daniel Richard Higgins, Tigard, OR (US); Eugene Sullivan, Mobile, AL (US)

( * ) Notice: Subject to any disclaimer, the term of this patent is extended or adjusted under 35 U.S.C. 154(b) by 1187 days.

(21) Appl. No.: 12/471,081

(22) Filed: May 22, 2009

Related U.S. Application Data

(60) Provisional application No. 61/055,802, filed on May 23, 2008.

(51) Int. Cl.

| | |
|---|---|
| ***F23K 3/16*** | (2006.01) |
| ***F23B 80/02*** | (2006.01) |
| ***F23C 9/00*** | (2006.01) |
| ***F23G 5/04*** | (2006.01) |
| ***F23L 15/00*** | (2006.01) |

(52) U.S. Cl.
USPC ..... 110/118; 110/204; 110/224; 110/293; 110/302

(58) Field of Classification Search
USPC ..... 110/108, 115, 116, 117, 118, 101 R, 110/224, 227, 229, 230, 204, 293.302
See application file for complete search history.

(56) References Cited

U.S. PATENT DOCUMENTS

| | | | | |
|---|---|---|---|---|
| 2,151,642 | A * | 3/1939 | Rose | 122/4 R |
| 2,213,923 | A | 9/1940 | Stuart et al. | |
| 2,250,067 | A | 7/1941 | Martin | |
| 3,976,018 | A | 8/1976 | Boulet | |
| 4,170,183 | A | 10/1979 | Cross | |
| 4,254,715 | A | 3/1981 | LaHaye et al. | |
| 4,423,533 | A | 1/1984 | Goodspeed | |
| 4,528,945 | A * | 7/1985 | Virr et al. | 122/4 D |
| 4,577,363 | A | 3/1986 | Wyse | |
| 4,635,379 | A | 1/1987 | Kroneld | |
| 4,642,048 | A * | 2/1987 | Kim | 110/226 |
| 4,676,176 | A | 6/1987 | Bonomelli | |
| 4,822,428 | A | 4/1989 | Goodspeed | |
| 4,872,834 | A | 10/1989 | Williams, Jr. | |
| 4,884,516 | A | 12/1989 | Linsen | |
| 4,976,208 | A * | 12/1990 | O'Connor | 110/234 |

(Continued)

FOREIGN PATENT DOCUMENTS

| | | |
|---|---|---|
| JP | 08-245072 | 9/1996 |

OTHER PUBLICATIONS

"Diamond Rodding Robot," http://www.diamondpower.com.au/pdf/diamondpower/AncillaryEquipment/Rodding_robot.pdf.

*Primary Examiner* — Kenneth Rinehart
*Assistant Examiner* — David J Laux
(74) *Attorney, Agent, or Firm* — Scheinberg & Associates, PC; Michael O. Scheinberg; John B. Kelly

(57) ABSTRACT

A system for drying solid fuels prior to injection and burning in solid fuel boilers is described. High moisture content solid fuels such as bark, sludge, wet coal, are preferably dried to some degree before they can burn. The present invention incorporates a delivery chute in which combustion gases dry the solid fuel before it reaches the combustion chamber of the boiler. In one embodiment, the combustion gases are drawn through the delivery chute to remove moisture from the incoming fuel and then the gases flow back into the boiler. A second embodiment directly exposes the wet fuel to the combustion in the boiler for a sufficient time to remove a substantial amount of moisture before the fuel is spread onto the solid fuel combustion region.

20 Claims, 3 Drawing Sheets

(56) References Cited

U.S. PATENT DOCUMENTS

| | | | | |
|---|---|---|---|---|
| 5,001,992 | A | 3/1991 | Higgins et al. | |
| 5,069,146 | A | 12/1991 | Dethier | |
| 5,226,375 | A * | 7/1993 | Fukuda | 110/346 |
| 5,239,935 | A | 8/1993 | Morrow et al. | |
| 5,313,892 | A | 5/1994 | Tice | |
| 5,401,130 | A * | 3/1995 | Chiu et al. | 110/245 |
| 5,414,887 | A | 5/1995 | Abel et al. | |
| 5,724,895 | A | 3/1998 | Uppstu | |
| 5,794,548 | A | 8/1998 | Barlow | |
| 6,047,970 | A | 4/2000 | Friend et al. | |
| 6,358,042 | B1 * | 3/2002 | Moriguchi | 432/227 |
| 6,532,880 | B2 | 3/2003 | Promuto | |
| 2009/0270817 | A1 | 10/2009 | Moreno et al. | |

* cited by examiner

METHOD AND APPARATUS FOR DRYING SOLID FUELS

This application claims priority from U.S. Prov. Pat. App. No. 61/055,802, filed May 23, 2008, which is hereby incorporated by reference.

TECHNICAL FIELD OF THE INVENTION

The present invention relates to removing moisture from fuel for a solid fuel boiler.

BACKGROUND OF THE INVENTION

Solid fuel boilers are commonly used by industry and utilities to generate steam for process requirements and to generate electricity. These boilers burn bark, coal, sludge, wood waste, refuse, tires, and other organic materials, often in combinations, and with fossil fuels. Generally, the organic materials have high moisture contents and are stored outdoors where they are often wet from rain water or, in the case of sludge, reclaimed from wastewater treatment facility.

In some cases, some of the moisture is removed before the fuel is delivered to the boiler by means of mechanical presses or drying chambers using hot gases from the discharge of the boiler. For example, U.S. Pat. No. 3,976,018 to Boulet teaches a fuel dryer for bagasse fuel. The dryer is separate from the boiler and uses alternating fixed and rotating conical trays over which the fuel passes downward while stack gases pass over the fuel to dry it. The fuel empties into a hopper for transporting to other equipment. U.S. Pat. No. 6,532,880 to Promuto teaches a system for drying sludge, including a shaftless spiral feed screw for moving sludge through a drying chamber as a high energy inductor draws hot gases through the chamber to dry the sludge as it advances through the chamber. U.S. Pat. No. 4,635,379 to Kroneld describes a dryer in which fuel travels on a conveyor bed while steam moves through the fuel from underneath. U.S. Pat. No. 4,254,715 to LaHaye et al. teaches a drying system in which heated air passes over the fuel in a combustion chamber, as burning occurs substantially at the bottom of the pile of fuel.

These drying systems are often troublesome, expensive, risky, and not particularly efficient. With many of these methods, the fuels still contain undesirably high moisture content. In any case, essentially all of the water in the fuel must be removed during the combustion process and when the fuels are wet the combustion process can be unstable and inefficient. The situation is further exacerbated by variable moisture contents of the fuel (e.g., from rain) that introduces variations into the combustion process and makes it more difficult to operate the boilers. Solid fuel boilers are typically constructed as large boxes (up to 100 square meters or more in floor area) with heavy steel tubing forming the walls of the box, typically referred to as the front, sides, and rear walls. The tubing typically has an outer diameter of 63.5 mm or 76.2 mm and is arrayed in parallel relationship forming flat panels, with the tubes running vertically. The tubes are typically spaced apart about 10-12 mm, with a steel membrane or fin bridging the gap. The whole assembly is seal welded together forming an air tight structure. The boiler walls, or tube panels, run vertically to the top of the boiler, up to 30 m or more tall. The walls are fed re-circulating water by headers at their lower extremity. Typically the front wall tubes are bent over more or less horizontally to form the roof of the boiler and the side walls end in relieving headers feeding back to a steam drum. The rear wall either ends in a header or feeds directly into the steam drum. In order to feed fuel and combustion air into the boiler, and to provide openings for other purposes, the boiler tubes are bent to spread them apart to form openings in the tube panel. The bottom of the boiler may be arranged to include a combustion support, such as a grate, a fluidized bed, or other arrangement. Grates include traveling grates, vibrating grates, tilting grates, and hydro-grates. Typically, the grates cover the bottom of the boiler and are made of heavy cast iron components with slots for combustion air to rise through the grate from a plenum below. The solid fuel lands on the grate and burns there. The ash is dumped off of the grate as the grate moves (rotates like a tank tread), vibrates, or tilts (in sections). Fluidized beds generally have a mass of sand or other media through which a stream of air or boiler flue gas is percolated to fluidize the bed. The fluidized bed acts as a heat sink, fuel drying system, turbulent fuel/air mixing system, fuel distribution system, and means for separating fuel and ash in the boiler. Additional combustion air ports, typically called "over fired air" (OFA) are arranged to blow air in above the grate or fluidized bed to help complete the combustion. In all of these arrangements, excessive moisture in the fuel causes poor combustion, which can result in poor operational efficiencies and high environmental emissions. The volume contained within the boiler walls is referred to herein as the "combustion chamber." The region where most of the solid fuel burns, that is, on the grate or at the fluidized bed, is referred to herein as the "combusting zone." It is understood that combustion of airborne combustible matter also takes place in the combustion chamber outside of the combusting zone.

In common practice the solid fuel is fed by gravity through large chutes, steeply mounted and having a cross section of about 500 mm square, from a hopper and/or conveyor system above, to the lower portion of the boiler just above the grate or fluidized bed. There are typically multiple chutes penetrating a wall or walls of the boiler. A solid fuel distributor is often integral with and at the bottom of the chute, right at the interface with the boiler wall. Mechanical distributors and pneumatic distributors are commonly used. Grate type boilers generally require some type of fuel distribution whereas fluidized bed boilers can be run without them as the fluidized bed can distribute the fuel, albeit inefficiently. Typically, the fuel slides down the chute and enters the boiler with high residual moisture content (up to 50% or more). The water in the fuel inhibits the combustion in the furnace, often requiring the continual use of supplemental fossil fuels to provide additional heat to compensate for the moisture. It is also very common for the load rate on these boilers to change frequently in reaction to changing steam demands. Inconsistent and high moisture content of the fuels makes it difficult for the boiler to respond effectively to the required load changes. This requires, again, the use of supplemental fossil fuels to improve the response of the boiler to load rate changes. Fossil fuels are typically used to start these boilers but continual use of fossil fuels is extremely expensive. Fluidized beds can help to compensate for varying moisture contents and load rates because they act as heat sinks, but they can have significant operational and mechanical problems such as sand sintering and sand erosion and they require a sand reclamation system. There is great demand for a simple means to dry solid fuels so that they are delivered to the boiler combustion chamber ready to burn. Such a system is preferably inexpensive to install and operate, reliable, effective, and safe. Various embodiments of the present invention, described below, address one or more of these challenges and provide one or more, and preferably all of these advantages.

SUMMARY OF THE INVENTION

It is an object of the invention to provide an efficient, robust means to reduce the moisture content of solid fuels so that they are delivered to the boiler combustion in a better condition to burn.

Embodiments of the invention dry fuel as it is being provided to the boiler through a delivery chute. In one embodiment, hot gases are drawn through the chute to dry the fuel as it is coming down the chute toward the combustion zone. In another embodiment, the fuel is dried by exposing it to the combustion zone environment as the fuel is being delivered.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more through understanding of the present invention, and advantages thereof, reference is now made to the following descriptions taken in conjunction with the accompanying drawings, in which.

Figure 1:
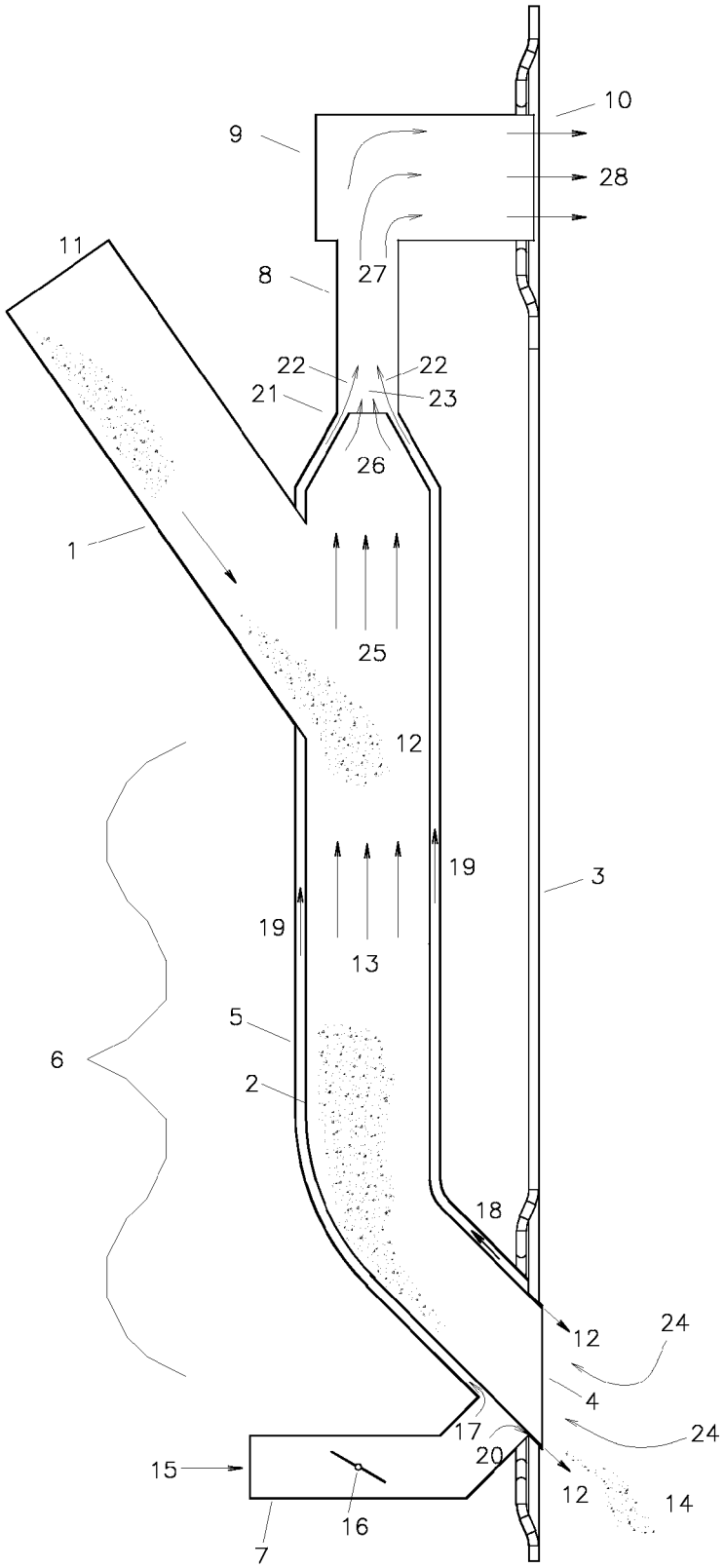
FIG. 1 is a sectional side view elevation of a first embodiment of the invention.

To the right of the drawing is the interior of the boiler where the fuel is burned. To the left of the drawing is outside the boiler.

DETAILED DESCRIPTION OF PREFERRED EMBODIMENTS

FIG. 1 is a sectional side view elevation of a first embodiment of the invention. To the right of the drawing is the interior of the boiler where the fuel is burned. To the left of the drawing is outside the boiler. Referring to FIG. 1, an upper solid fuel chute 1 is arranged to deliver fuel by gravity feed to a lower fuel chute 2. Upper chute 1 may be made from carbon steel whereas lower chute 2 may be made from a high temperature and corrosion resistant alloy, with heavy wall construction. Lower chute 2 passes through the boiler tube wall 3 and enters the boiler at a first opening 4. An outer plenum 5 is arranged around the exterior of lower chute 2 suitably sized to provide adequate flow of a cooling medium, such as air, for cooling lower chute 2 and to induce a draft in a drying zone 6 as described below. An air duct 7 provides cool air to the plenum 5. An exit duct 8 leads to a nozzle 9 that also passes through the tube wall 3 at point 10. When the system is operating, moist solid fuel enters upper chute 1 at a second opening 11. Upstream of opening 11 is a rotary feeder (not shown) or other form of air lock that prevents air from entering upper chute 1. The moist solid fuel enters lower chute 2 at point 12 where it encounters a rising column of hot boiler gas 13. The moist fuel mixes with the hot gas from the boiler and substantial fraction of the moisture in the fuel is removed as the fuel falls through the counter flowing gas and enters the boiler at point 14. To induce the upward flow of boiler gas, air enters duct 7 at point 15, passes a control damper 16, and enters plenum 5 at point 17 and flows up the plenum as shown at points 18 and 19. A small portion of the combustion air 20 is diverted to cool the lower portion of lower chute 2. As the air passes through plenum 5 it cools lower chute 2 and heats up along the way. As the air temperature increases, its density decreases therefore the velocity of the air increases proportionately. The rapidly moving air exits plenum 5 at a third opening 21 where it flows into duct 8. The top of the lower chute 2 and plenum 5 are designed such that as the air exits plenum 5 at points 22, a low pressure region or vacuum is created at point 23. This induces a flow of boiler gas 24 into lower chute 2 where it flows up at 13 and 25, and out at 26. A mixture of boiler gas, water vapor, and air 27, is then immediately returned to the boiler at point 28 via nozzle 9. As the boiler gas 24 enters lower chute 2, it is very hot and will dry the fuel very quickly and can potentially ignite the fuel while it is still in chute 2. While chute 2 is preferably constructed to withstand combustion internally that is not desirable, therefore the flow of boiler gas into the drying zone 6 is regulated by the flow of air 15 through duct 7 and into the plenum 5. Increasing the air flow 15 will increase the vacuum at 23 and increase the boiler gas flow 24 into the drying zone 6. Likewise reducing the flow of air 15 will reduce the vacuum at 23 and reduce the boiler gas flow 24. In this manner only enough boiler gas is induced to enter chute 2 as required to dry the fuel. Airflow 15 is controlled by damper 16 or some other means and may be integrated into a means that monitors the combustion or moisture of the fuel, or temperature of the gases, to enable automatic control of the amount of boiler gas that enters the device. The embodiment described above has several advantages. It is simple with essentially no moving parts. It can be made very robustly yet inexpensively and can be easily adapted to fit all manner of boilers and solid fuel types. Installation of the device on existing boilers is simple and inexpensive and the device can be adapted to any manner of solid fuel injection system. The device can be self regulating in that the boiler gas entering the drying chamber increases only as the cooling medium (air in plenum 5) increases, therefore the increased cooling load is anticipated by the increased cooling flow.

In different embodiments, the driving forces for the cooling media and the driving forces for the hot gas can be active or passive. Similarly, the control mechanisms for controlling the flow of the cooling media and the control mechanisms for controlling the flow of the hot gas can be active or passive. The systems for driving and controlling the cooling media flow can be interrelated or independent from the systems for driving and controlling the hot gas flow.

In some embodiments, the rate of flow of cooling media through the plenum can be passively controlled by the temperature of the chute, with the flow increasing as the temperature of the chute increases, without requiring sensors, electronic controllers, and controllable valves. In some embodiments, however, active controls, including temperature sensors, automatic or manual valves, and air moving devices, can be used to control the flow of the cooling medium in the plenum. A combination of active and passive controls may also be used to control the flow of cooling media in the plenum, with the cooling flow anticipating the heating flow, as described above.

In some embodiments, the flow of hot gas can be controlled by controlling, actively or passively, the flow of air through the plenum. In other embodiments, the flow of hot gas through the fuel is controlled independently of the cooling media flow, for example, by using sensors and controllable dampers, in additional to or instead of controlling the flow of air through the plenum.

A difference in pressure at different points of the chute containing fuel causes hot gas to be drawn through the fuel in the drying zone of the chute removing moisture. In the embodiment of FIG. 1, a low pressure region is formed by the air exiting the plenum which draws hot gas into the chute and through the fuel in the drying zone. Cooling media is drawn through the plenum by the heating and consequent rising of the cooling media as it absorbs heat from the chute. If the cooling media flow is insufficient, it can be augmented or replaced by forcing additional cooling media though the plenum, for example, by a fan or other air moving means.

In other embodiments, a low pressure region for drawing the hot gas through the chute can be created by other means, such as by an inductor or other type of fan. Such air moving devices can be used to cause hot gas flow in addition to or instead of the hot gas flow caused by the low pressure region supplied by the air exiting the plenum. Alternatively, hot gases can be driven through the fuel by a high pressure region on one end of the chute. In one embodiment the hot gas is drawn from the combustion chamber through the same place where the fuel enters the combustion chamber. In other embodiments, the hot gas could enter the chute at a different location or a hot gas other than gas directly from the combustion chamber could be used. For example, a pneumatic fuel spreader at the bottom of the chute can create a low pressure zone at the bottom of the chute that draws hot gas through the drying zone from an opening further up the chute. In such a case, the hot gas flows in the same direction as the fuel in the chute. Hot gas can be drawn into the chute above the fuel, flow in the same direction as the fuel and exit with the fuel into the combustion chamber. In some embodiments, hot or cold gas can be injected at high pressure or volume into the chute to dry the fuel and to draw additional hot gas through the chute.

One embodiment can be easily controlled by monitoring the gas temperature in the drying chamber and is inherently safe because the air is only mixed with the boiler gas immediately before it is re-injected into the boiler.

Figure 2:
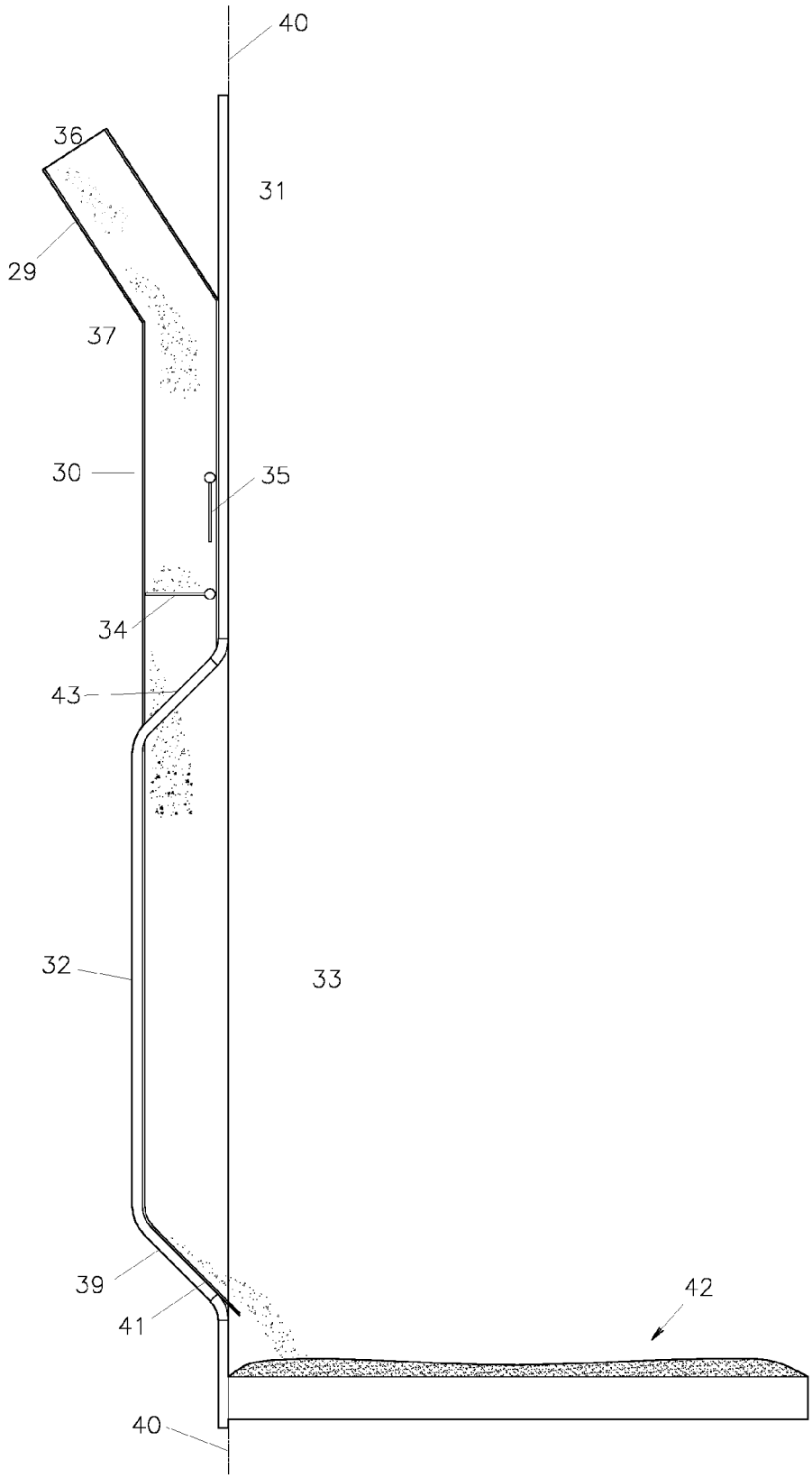
FIG. 2 is a sectional side view elevation of a second embodiment of the invention, in which the fuel is exposed to the interior environment of the combustion chamber as it moves through a portion of the chute.

FIG. 2 is a sectional side view elevation of a second embodiment of the invention. To the right of the drawing is the interior of the boiler where the fuel is burned. To the left of the drawing is outside the boiler. The second embodiment of the invention is even simpler in its design than the first embodiment. In this embodiment the fuel chute 29 descends from above at an angle and intersects a vertical chute 30 with a vertical dimension determined by the variable drying requirements of the fuel as described below. Vertical chute 30 is arranged immediately adjacent to the boiler tube wall 31. The boiler tube wall 31 along which the chute is positioned defines a boiler tube wall plane 40, which is the plane containing most of the boiler tubes. While in a rectangular boiler 2, boiler wall plane 40 is flat, if the boiler walls are curved in an embodiment, the boiler tube wall plane 40 would also be curved.

The boiler tubes are bent out of the plane 40 of the tube wall to form a lower chute 32 that has only three sides, the fourth side is open to the boiler and exposed to the combustion in the boiler 33. Exposed chute 32 terminates at its bottom in fuel spreader, such as an angled portion 39 back to the plane of the tube wall. The sides and back of exposed chute 32 may be lined with a suitable high temperature and corrosion resistant material. A mechanical or pneumatic bark distributor can be used as a fuel spreader and can be arranged to fit at the bottom of chute 32 to distribute the fuel to the combusting zone 42. A fuel spreader need not be a complicated device, and can be any surface above the combustion region onto which fuel falls before falling onto the combusting zone.

In this embodiment, the fuel when moving through exposed chute 32 is preferably inside the combustion chamber, that is, it is within the tube walls of the combustion chamber. The fuel traveling in exposed chute 32 is preferably not directly over combusting zone 42 and is preferably not falling directly into the grate or bed. That is, the fuel preferably falls in a chute above and to the side of the solid fuel combustion region. The fuel exiting exposed chute 32 is then distributed by fuel spreader 41 onto the solid fuel combustion region, typically a bed or grate. The fuel is exposed to the interior of the combustion chamber before reaching the fuel spreader. The distance between the points where the fuel enters the combustion chamber and the fuel spreader is sufficiently great so that a significant amount of moisture is removed from the fuel as it falls toward the fuel spreader. For example, more than 10%, of the moisture can be removed. The distance through which the fuel falls while being exposed to the combustion chamber interior is preferably at least two meters. While falling within the chute inside the combustion chamber, the fuel is exposed to both radiant heating and convective heating by the hot gas in the combustion chamber. In a preferred embodiment, incorporated into vertical chute 30 are multiple adjustable barriers, such as stop plates 34 and 35, that control the rate of flow of fuel through the chute, for example, by controlling the height from which the fuel falls by gravity.

Wet fuel enters chute 29 at 36 and flows into chute 30 at point 37. If the fuel is relatively dry, stop plates 34 and 35 will be in the open position (35 is shown open, 34 is shown closed) and the fuel will accelerate by gravity to a higher velocity as it passes through exposed chute 32 where it dries from exposure to the hot gas and radiation from the combustion in the boiler. If the fuel is relatively wet, stop plates 34 or 35 will be closed to momentarily interrupt the flow of the fuel. When the stop plate reopens, the fuel is dropped from a lesser height; therefore it passes through exposed chute 32 more slowly with more time to dry. The vertical heights of exposed chute 32 and vertical chute 30 are determined by the drying requirements of the fuel. Likewise the number of stop plates is determined by the variability in the moisture content of the fuel. The stop plates can be arranged to operate manually by a counterweight arrangement so that the selected stop plate will automatically open when a certain amount of fuel accumulates on it. Alternatively, the stop plates can be controlled automatically by a variety of means. The section 43 of the tube wall through which fuel passes on its way into the combustion chamber is preferably not vertical, that is, the tube wall is tilted and has a horizontal component where the chute enters the combustion chamber. The second embodiment has the advantage of being extremely simple in design, and although the boiler gas is not drawn through the fuel, the fuel is exposed to radiation from the boiler. Embodiments preferably use gravity feed in the chute without mechanical feed devices, such as the moving trays of Boulet or the screw of Promuto. Unlike LeHaye et al., embodiments of the present invention preferably remove moisture from the fuel before it reaches the grate or bed in or on which it is burned.

Figure 3:
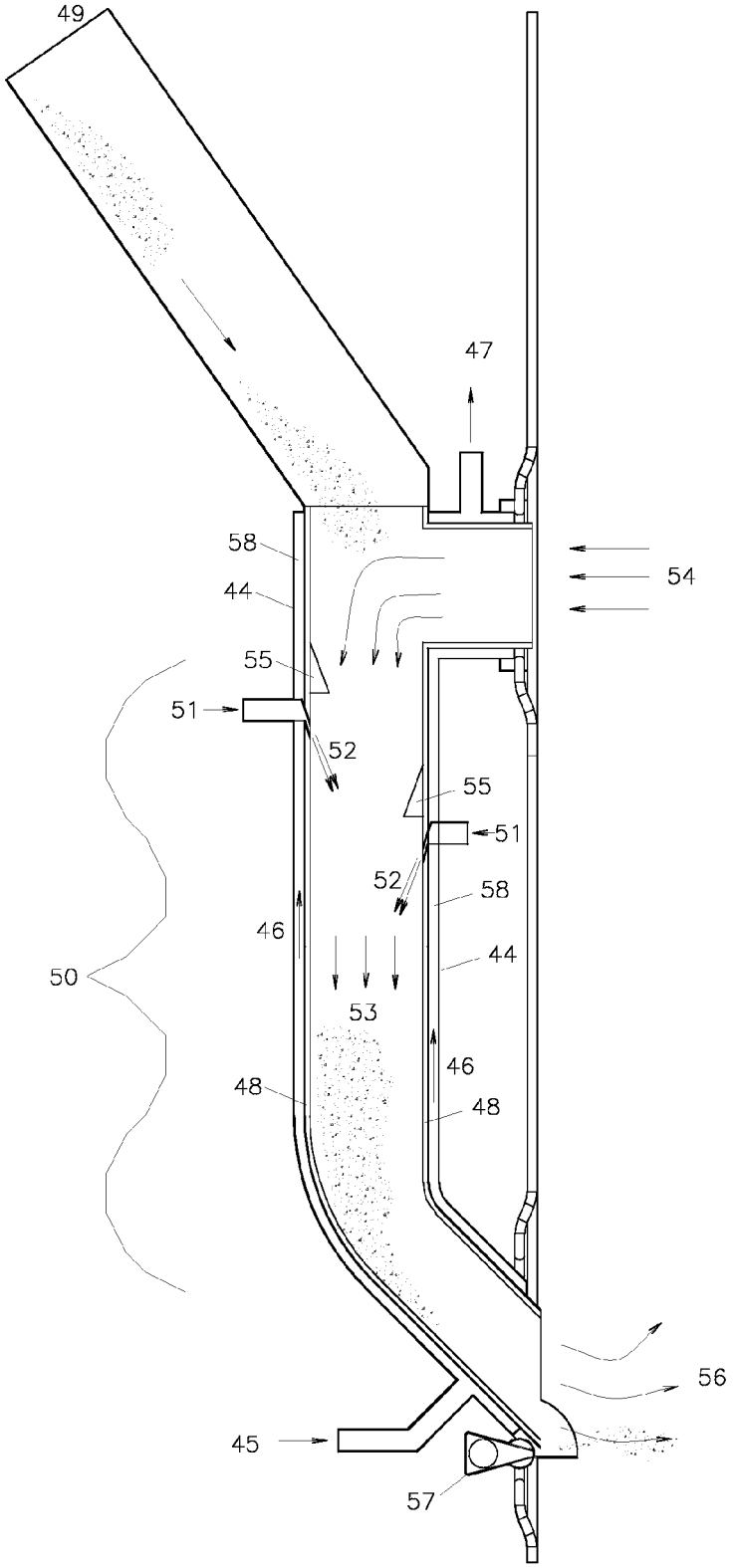
FIG. 3 is a sectional side view elevation of a third embodiment of the invention that uses a liquid to cool the chute.

FIG. 3 is a sectional side view of a preferred embodiment of the invention. In this embodiment the cooling media 58 is water flowing in a plenum comprised of a jacket 44 surrounding the fuel chute. The plenum could also be comprised of water filled tubes. Plenum as used herein includes any passage, whether individual tubes, a wide passage, or some other fluid conduit, through which a cooling medium flows in thermal contact with the chute. Water flows into the water jacket at 45 and flows up through the jacket at 46 exiting eventually at 47. The water is either pumped through the jacket or flows by natural convection. Some or all of the water may evaporate or boil in the jacket in which case steam or a mixture of water and saturated steam exits at 47. In this embodiment the interior of the chute is lined with a ceramic refractory 48 to protect the metal from erosion and over-heating. Fuel enters the upper portion of the chute at 49 then drops into the drying portion 50. Recirculated boiler flue gas 51 is injected under pressure at multiple locations 52, in a direction substantially parallel to the desired gas flow direction. This induces a downward flow of gas in the chute 53 drawing hot boiler combustion gas into the chute at 54. Thus, in this embodiment, the hot gas flows in the same direction as the fuel through the chute. Upon falling into the drying zone 50 the fuel encounters multiple diverters 55 that slow the free fall of the fuel and push the fuel back and forth in the chute increasing the mixing of the fuel and hot gas. The gas and fuel flow downward together drying the fuel and then exit with the liberated water vapor into the boiler at 56. A fuel distributor 57 may be located at the bottom of the chute to distribute the fuel into the boiler.

The third embodiment has the advantage of much higher heat tolerance than the first embodiment while still requiring little modification to existing boilers. Furthermore, the downward flow of gas requires less energy to create as it is flowing in the direction of the falling fuel and will not be counter to the direction of the injection of the fuel and gas by the fuel distributor. While three embodiments of the present invention have been shown and described, it will be apparent to those skilled in the art that many changes and modifications may be made without departing from the invention in its broader aspects. The term "solid fuel" includes wet fuels, such as sludge, wet coal, and other such fuels that are useful in boilers of the type described above. The term "chute" includes any passage by which fuel is delivered to the boiler. The cooling plenum shown outside could also be formed as conduits such as pipes inside.

In each embodiment, sufficient moisture is removed from the fuel to improve combustion. The amount of moisture removed will depend on the moisture of the incoming fuel, the size of the fuel particles, the differential temperature and velocities between the combustion gas and the fuel, and the contact time between the fuel and the gas. The size of the fuel particles vary and typically range from sawdust to several inches long pieces of wood or bark. The contact time is limited therefore only the smallest particles will dry completely in the chutes and will enter the boiler ready to burn. Mid size particles will lose their surface moisture and some internal moisture. Larger particles will lose only surface moisture. In the described embodiments of the present invention, the transfer of heat to the fuel is thought to be dominated by radiation. In the prior art, the internal temperature of fuel chutes typically does not exceed 350 degrees F. Fahrenheit or so. In embodiments of the present invention, the interior of the chute may be heated to more than 350 degrees F., more than 500 degrees F., more than 700 degrees F., or more than 1000 degrees F., measured away from the entrance to the combustion chamber. Boiler combustion gas, however, is typically over 2000 degrees Fahrenheit, even as hot as 2500 degrees. Radiant heat transfer, among other parameters, is a function of differential temperature to the $4^{th}$ power. Therefore embodiments of the present invention may increase the heat transfer to the fuel by from 500 to 1000 times over existing fuel chutes with no auxiliary heating. Physical constraints around the boiler limit the height of the drying chute and therefore the contact time between the fuel and the hot gas. There are also practical limits on how much gas can be drawn through the chute. These constraints limit the drying in the chutes in most embodiments for large particles to removing more than 10%, more than 15% or removing about 25% of the moisture carried by the fuel for some fuels. For fuels such as sawdust, having small particles, the embodiments of the invention can remove, for example, more than 25%, more than 50% or more than 75% of the moisture from the fuel before it reaches the combusting zone.

Although embodiments of the present invention and various advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The appended claims are therefore intended to cover all such changes and modifications as fall within the true spirit and scope of the invention.

We claim as follows:

1. A solid fuel boiler, comprising:

walls defining a combustion chamber;

a combusting zone within the combustion chamber into which the solid fuel is delivered for combusting;

a gravity-feed chute for delivering solid fuel into the combustion chamber, the chute including:

a first opening from which solid fuel enters the combustion chamber;

a second opening for accepting solid fuel into the chute, and a third opening from which hot gas from the combustion chamber for drying the fuel enters the chute at the third opening and leaves the chute at the first opening, the hot gas mixing with the solid fuel in at least a portion of the chute to remove moisture from the solid fuel; and a plenum in thermal contact with the gravity-feed chute, a cooling medium passing through the plenum being heated by the hot gas in the chute.

2. The solid fuel boiler of claim 1 in which the hot gas is induced to flow through the chute by the injection of a gas.

3. The solid fuel boiler of claim 1 further comprising a damper for regulating the flow of the cooling medium in the plenum.

4. The solid fuel boiler of claim 1 in which the chute includes a refractory lining.

5. A solid fuel boiler, comprising:

walls defining a combustion chamber;

a combusting zone within the combustion chamber into which the solid fuel is delivered for combusting;

a gravity-feed chute for delivering solid fuel into the combustion chamber, the chute including:

a first opening from which solid fuel enters the combustion chamber;

a second opening for accepting solid fuel into the chute, and a third opening from which hot gas from the combustion chamber enters or leaves the chute, the hot gas mixing with the solid fuel in at least a portion of the chute to remove moisture from the solid fuel;

a plenum in thermal contact with the gravity-feed chute, a cooling medium passing through the plenum being heated by the hot gas in the chute; and a fuel spreader for spreading fuel from the first opening, the fuel being heated to remove moisture in the chute prior to the fuel being spread by fuel spreader.

6. The solid fuel boiler of claim 5 in which the fuel spreader comprises an inclined surface, a pneumatic fuel distributor, or a mechanical fuel distributor.

7. The solid fuel boiler of claim 5 further comprising a damper for regulating the flow of the cooling medium in the plenum.

8. The solid fuel boiler of claim 5 in which the hot gas is induced to flow through the chute by the injection of recirculated boiler flue gas.

9. The solid fuel boiler of claim 5 in which the chute includes a refractory lining.

10. A solid fuel boiler for burning solid fuel to heat a working fluid, comprising:

a combustion chamber having combustion chamber walls through which a working fluid flows and a combustion support at which the solid fuel is burned;

a chute for delivering solid fuel into the combustion chamber, at least a portion of the chute being contiguous with the combustion chamber so that fuel flowing through the portion of the chute is exposed to the interior of the combustion chamber to remove moisture from the fuel as it is being delivered to a combusting zone, in which at least the last two meters of the chute is comprised, at least in part, of boiler tubes that are bent out of the plane of the tube wall, the portion of the chute not comprised of boiler tubes being cooled by a gaseous or liquid cooling medium flowing through a plenum in thermal contact with the chute; and a combustion support for supporting the solid fuel near the bottom of the boiler during combustion, the fuel traveling a sufficient distance in the portion of the chute such that a significant amount of moisture is removed before the fuel reaches the combustion support.

11. The solid fuel boiler of claim 10 in which the chute includes a refractory lining.

12. The solid fuel boiler for burning solid fuel to heat a working fluid, comprising:

a combustion chamber having combustion chamber walls through which a working fluid flows and a combustion support at which the solid fuel is burned;

a chute for delivering solid fuel into the combustion chamber, at least a portion of the chute being contiguous with the combustion chamber so that fuel flowing through the portion of the chute is exposed to the interior of the combustion chamber to remove moisture from the fuel as it is being delivered to a combusting zone, in which at least the last two meters of the chute is comprised, at least in part, of boiler tubes that are bent out of the plane of the tube wall; and a combustion support for supporting the solid fuel near the bottom of the boiler during combustion, the fuel traveling a sufficient distance in the portion of the chute such that a significant amount of moisture is removed before the fuel reaches the combustion support;

a fuel spreader for spreading the fuel from the chute into the combusting zone.

13. The solid fuel boiler of claim 12 in which the chute includes a refractory lining.

14. solid fuel boiler comprising:

walls defining a combustion chamber;

a combusting zone within the combustion chamber into which the solid fuel is delivered for combusting;

a gravity-feed chute for delivering solid fuel into the combustion chamber, the chute including:

a first opening from which solid fuel enters the combustion chamber;

a second opening for accepting solid fuel into the chute, and a third opening from which hot gas from the combustion chamber enters or leaves the chute, the third opening being at an elevation above where the fuel enters the boiler, the hot gas mixing with the solid fuel in at least a portion of the chute to remove moisture from the solid fuel; and a plenum in thermal contact with the gravity-feed chute, a cooling medium passing through the plenum being heated by the hot gas in the chute.

15. The solid fuel boiler of claim 14 further comprising a damper for regulating the flow of the cooling medium in the plenum.

16. The solid fuel boiler of claim 14 in which the hot gas is induced to flow through the chute by the injection of recirculated boiler flue gas.

17. The solid fuel boiler of claim 14 in which the chute includes a refractory lining.

18. solid fuel boiler comprising:

walls defining a combustion chamber;

a combusting zone within the combustion chamber into which the solid fuel is delivered for combusting;

a gravity-feed chute for delivering solid fuel into the combustion chamber, the chute including:

a first opening from which solid fuel enters the combustion chamber;

a second opening for accepting solid fuel into the chute, and a third opening from which hot gas from the combustion chamber enters or leaves the chute, the third opening being directly connected to the boiler, the hot gas is pulled into the chute by a downdraft, the hot gas mixing with the solid fuel in at least a portion of the chute to remove moisture from the solid fuel; and a plenum in thermal contact with the gravity-feed chute, a cooling medium passing through the plenum being heated by the hot gas in the chute.

19. The solid fuel boiler of claim 18 further comprising a damper for regulating the flow of the cooling medium in the plenum.

20. The solid fuel boiler of claim 18 in which the chute includes a refractory lining.

* * * * *